US008153917B2

(12) United States Patent
Xiao

(10) Patent No.: US 8,153,917 B2
(45) Date of Patent: Apr. 10, 2012

(54) MOVING CONTACT HEAD FOR TAP SWITCHES

(75) Inventor: Riming Xiao, Shanghai (CN)

(73) Assignee: Shanghai Huaming Power Equipment Co., Ltd., Shanghai (CN)

( * ) Notice: Subject to any disclaimer, the term of this patent is extended or adjusted under 35 U.S.C. 154(b) by 685 days.

(21) Appl. No.: 12/345,037

(22) Filed: Dec. 29, 2008

(65) Prior Publication Data

US 2009/0211887 A1 Aug. 27, 2009

(30) Foreign Application Priority Data

Feb. 26, 2008 (CN) ..... 2008 1 0033893

(51) Int. Cl.
*H01H 1/10* (2006.01)

(52) U.S. Cl. ..... 200/278; 200/11 TC

(58) Field of Classification Search ..... 200/278, 200/250, 257, 260, 11 TC
See application file for complete search history.

(56) References Cited

U.S. PATENT DOCUMENTS 3,360,618 A * 12/1967 Schunda ..... 200/11 TC
3,739,111 A * 6/1973 Wittenzellner et al. ... 200/11 TC
3,780,239 A * 12/1973 Guidosh ..... 200/11 B

* cited by examiner

*Primary Examiner* — Elvin G Enad
*Assistant Examiner* — Lisa Homza
(74) *Attorney, Agent, or Firm* — Squire Sanders (US) LLP

(57) ABSTRACT

A moving contact head for tap switches comprises a moving contact head installation plate component (200) rotating with a switch main shaft (100), and a holder-type moving contact head (300) arranged on the moving contact head installation plate component (200). The holder-type moving contact head (300) is divided into two sets of upper and lower moving contact head components, which are connected to each other and formed a holder shape; wherein, each moving contact head component comprises a moving contact head unit (320) consisting of a plurality of single moving contact heads (321) in parallel, and a leaf spring component (330) arranged on the moving contact head component (320); both ends of each single moving contact head (321) are provided with a contact point, respectively. A contacting ring (500) is clamped at one ends of the two moving contact head units (320), and a static contact head (600) is clamped the other ends of the two moving contact head units to deform a leaf spring (331) in the leaf spring component (330). However, the reaction force by the leaf spring (331) causes the moving contact head unit (320) to contact with the contacting ring (500) and the static contact head (600) to achieve on-state of large current.

8 Claims, 5 Drawing Sheets

MOVING CONTACT HEAD FOR TAP SWITCHES

CROSS-REFERENCE TO RELATED APPLICATIONS

This application claims priority to Chinese Patent Application No. 200810033893.4, filed on Feb. 26, 2008, entitled "A MOVING CONTACT HEAD FOR TAP SWITCHES, which is incorporated herein by reference in its entirety.

FIELD OF THE TECHNOLOGY

The present invention relates to transformer tap switch field, in particular to a moving contact (head) for transformer tap switches.

BACKGROUND OF THE INVENTION

Now the power supply net goes the way for high voltage and large current, and requires the increasing voltage and current of the transformer. Therefore, the tap switch matched with the transformer is required to have the ability of carrying high voltage and large current.

In the prior art, in order to increase the current-conducting capability of the contact head, two or more contact points can be arranged at one contact head end. Due to the external force and the internal stress in the process of manufacturing, it tends to make contact point(s) on the moving contact head with more contact points can't completely contact with the static contact head, so that the contacting resistance is larger, which doesn't play the role of increasing contact points and causes to heat and also shorten the lifetime of the contact points. It is now widely used, such as M type switch 1, as is shown in FIG. 1, and the front end of its contact head is equipped with two contact points 11 and 12.

Another method to increase current is that the spring is used to increase the contact pressure of the contact head. However, the pressure increase is limited, because the effect of pressure on current increase is reduced after the pressure is increased to a certain extent. On the other hand, too much pressure also has an adverse effect on the changeover between contact heads. There are movable contact heads used in such methods for increasing current, such as existing double-contact-point holder-type contact head, shown in FIG. 2. An upper contact head 21 and a lower contact head 22 of the double-contact-point holder-type contact head are holder-shaped and tightly compressed by using cylindrical helical spring 27. In order to increase the conductive capability of the upper contact head 21 and the lower contact head 22, the ends of the upper and lower contact heads 21, 22 are equipped with contact points 23, 24, 25 and 26, so that each end of the moving contact head 2 is corresponding up and down, that is, the moving contact head 2 has four contact points, but in this manner, the maximum current of the tap switch is also only 600 A.

SUMMARY OF THE INVENTION

The present invention provides a moving contact head for transformer tap switches, in order to overcome the shortcomings of the prior arts described above.

The technical problems in the present invention to be solved are achieved by the following technical measures: the moving contact head for transformer tap switch comprises a moving contact head installation plate component rotating with a switch main shaft, and a holder type moving contact head arranged on the moving contact head installation plate component. The holder type moving contact head is divided into an upper moving contact head component and a lower moving contact head component, which are connected to each other and formed a holder shape. Each moving contact head component comprises a moving contact head unit consisting of a plurality of single moving contact heads in parallel, and a leaf spring component arranged on the moving contact head component. A pressing force is applied to the moving contact head unit by the leaf spring component, and both ends of each single moving contact head are provided with a contact point, respectively.

The moving contact head component also comprises a support/housing in which the moving contact head unit and the leaf spring component are positioned. A first installation hole for the installation of the leaf spring component is arranged on one surface of the support, and the leaf spring component is also equipped with a second installation hole corresponding to the first installation hole. The leaf spring component is fixed on a surface in the support by a fastener passing through the first installation hole and the second installation hole.

The moving contact head unit is installed on the support through a round pin moving transversely throughout the moving contact head unit. The moving contact head unit can swing, at a certain around the round pin.

In order to cause the leaf spring components to respectively withstand and press single moving contact heads, both ends of the leaf spring component are equipped with leaf claws, and the number of the leaf claws is equal to that of the single moving contact heads. In order to ensure the insulation between the compact leaf spring component and the moving contact head unit, have the effect of magnetic and heat isolation, and avoid the burning out of the leaf spring component, each clawing head of the leaf claw of the leaf spring component is sleeved with an insulating sleeve.

The moving contact head installation plate component comprises a moving contact head rotary bracket which is arranged on a switch main shaft and rotates with it, and a U-shaped support/housing fixed at one end of the moving contact head rotary bracket. The holder-type moving contact head is fixed on the U-shaped support through a transverse pin.

The leaf spring component is formed by the superposition of a plurality of leaf springs, and the lengths of the leaf springs are shortened from bottom to top. Both ends of each leaf spring are equipped with leaf claws, and the number of the leaf claws is equal for the both ends of each leaf spring.

Because the technical measures/scheme described above is used, the present invention divides the moving contact head unit into a plurality of single moving contact heads, and each clawing head of the leaf claw at the two ends of the leaf spring component is used to compress each single moving contact head, ensuring that the contact point on each single moving contact head can have a good contact with the contacting ring and the static contact head, increasing the conductive capability of the tap switch. The leaf spring component used in the present invention has a small size, so that the structure of the moving contact head component is compact and thereby the tap switch can be designed to be more compact and reasonable. The present invention can meet the different conductive requirements of tap switches by changing the number of the single moving contact heads in the moving contact head unit.

DETAILED DESCRIPTION

The present invention is further described with reference to detailed accompanying drawings and detailed description.

Figure 6:
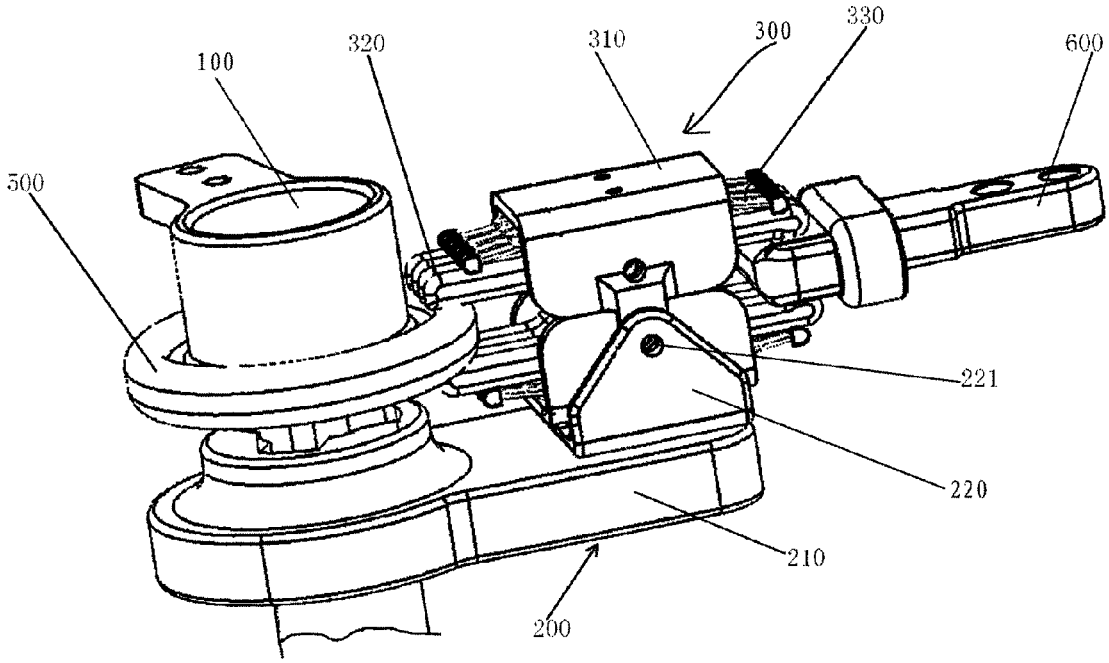
FIG. 6 is a diagram illustrating a moving contact head for tap switch described in the present invention is used in transformer tap switches.

Referring to FIG. 6, the moving contact head for transformer tap switches in this embodiment comprises a moving contact head installation plate component 200 rotating with a switch main shaft 100, and a holder-type moving contact head 300 arranged on the moving contact head installation plate component 200. The moving contact head installation plate component 200 comprises a moving contact head rotary bracket 210 and a U-shaped support 220; wherein, one end of the moving contact head rotary bracket 210 is fixed on the switch main shaft 100 to rotate the moving contact head rotary bracket 210 with the switch main shaft 400, and the U-shaped support 220 is fixed at the other end of the moving contact head rotary bracket 210 to cause the U-shaped support 220 driven by the moving contact head rotary bracket 210 to rotate with the switch main shaft 100. The holder-type moving contact head 300 is fixed on the U-shaped support 220 by a transverse pin 221. Thus, the holder-type moving contact head 300 is also rotated with the switch main shaft 400.

Figure 1:
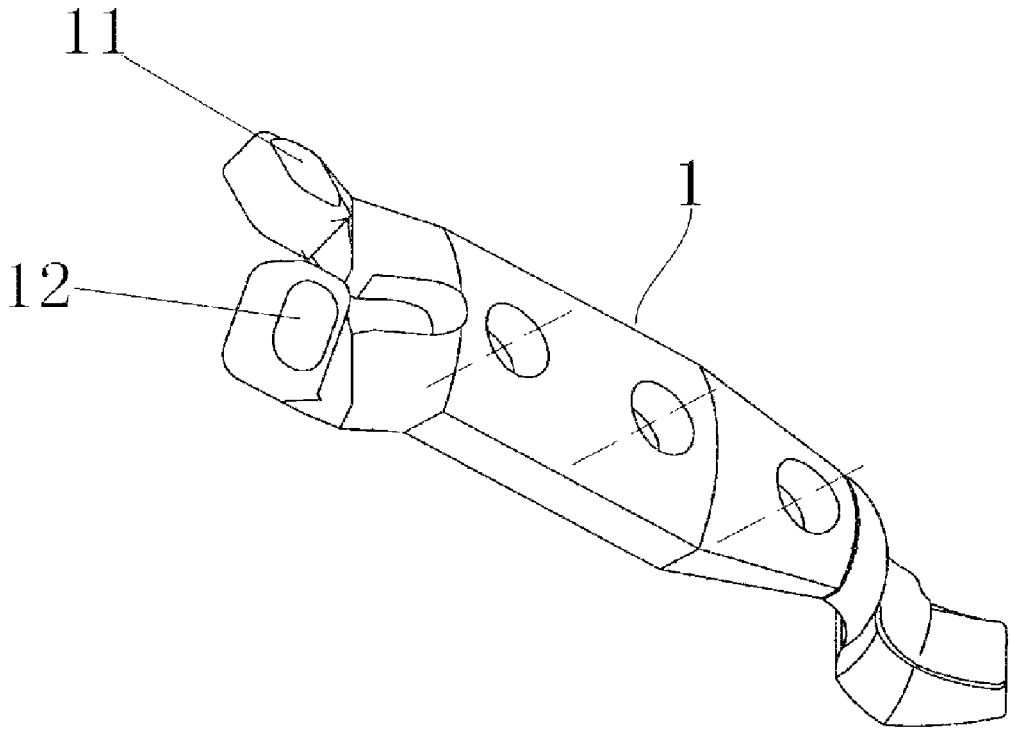
Fig. 1 (Prior Art)
FIG. 1 is a structural diagram of a double-contact-point moving contact head of a M type switch in the prior art.
Figure 2:
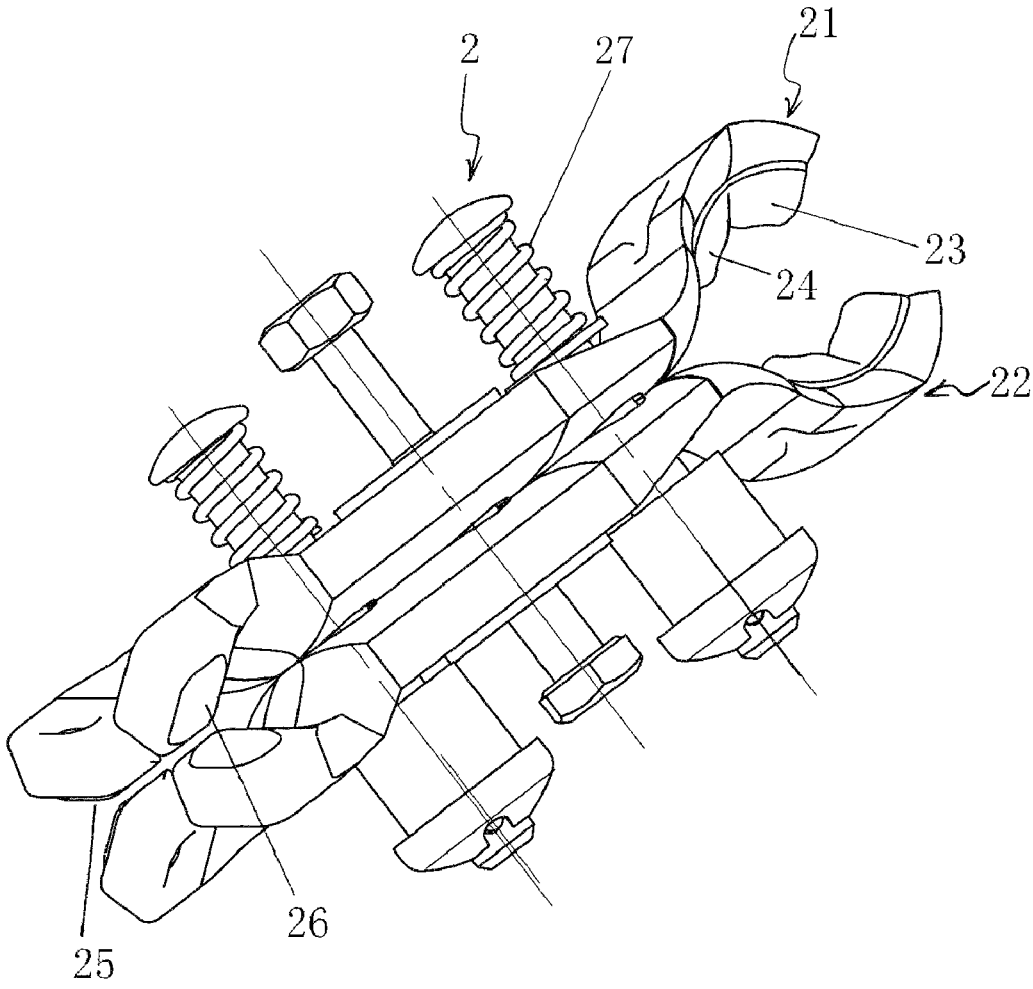
Fig. 2 (Prior Art)
FIG. 2 is a structural diagram of a double-contact-point holder-type moving contact head in said prior art.
Figure 3:
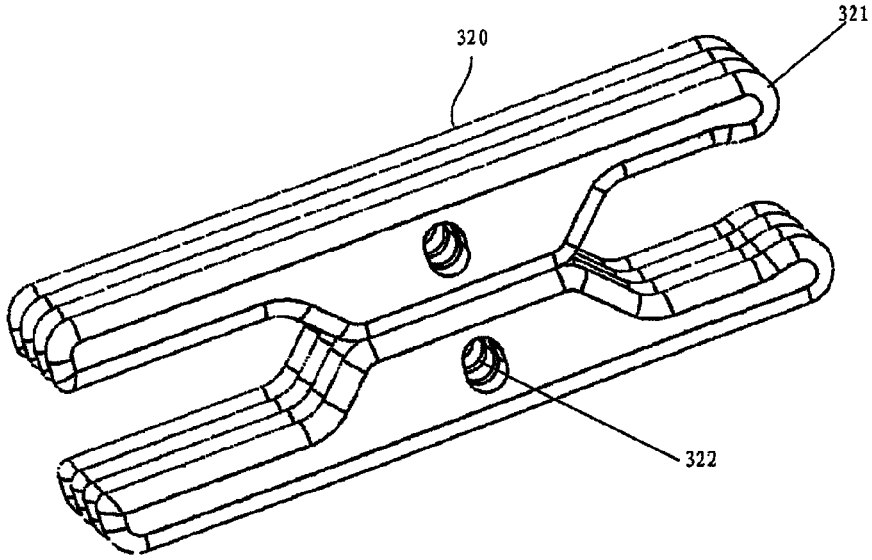
FIG. 3 is a structural diagram of a moving contact head unit described in the present invention.
Figure 5:
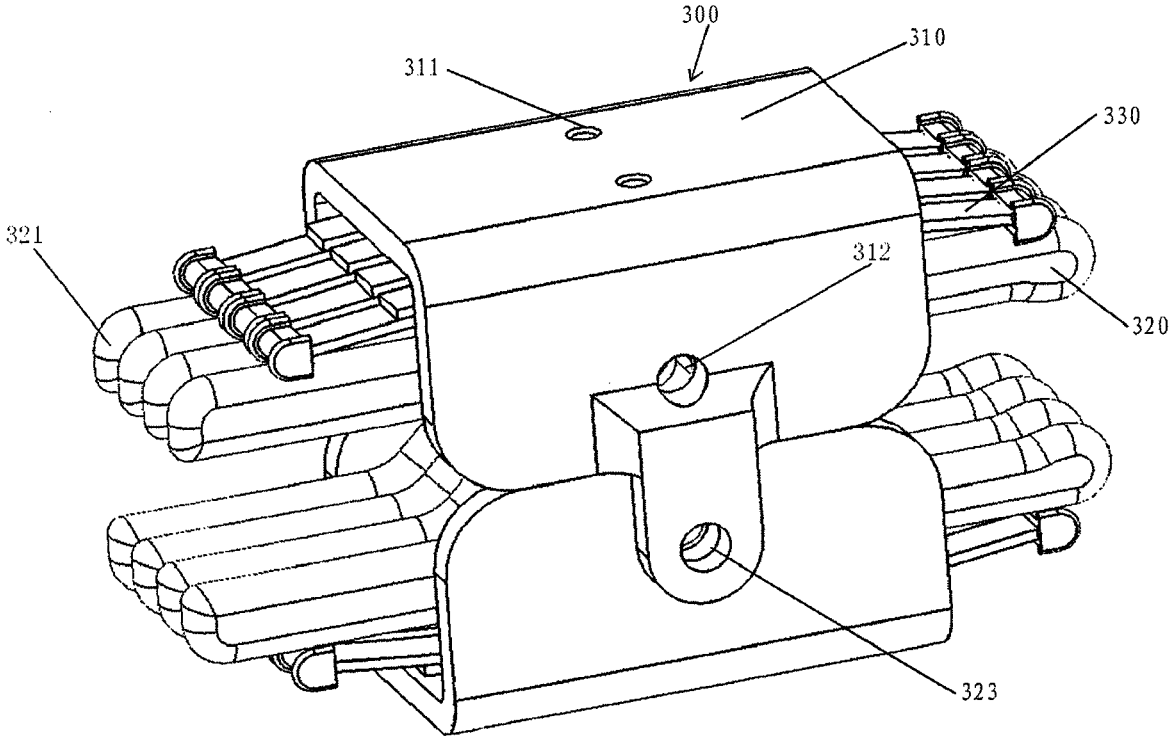
FIG. 5 is a structural diagram of a holder-type moving contact head described in the present invention.

Referring to FIG. 5, the holder-type moving contact head 300 is divided into two sets of an upper moving contact head component and a lower moving contact head component which are connected to each other and formed a holder shape. Each moving contact head component comprises a support 310, a moving contact head unit 320 and a leaf spring component 330; wherein, the support is a grooved structure; two first installation holes 311 for installation of the leaf spring component 330 are arranged on the bottom surface of the groove of the support 310; and a cylindrical pin hole 312 for installation of the moving contact head unit 320 is arranged at the groove edge of each side; wherein, the cylindrical pin hole 312 on the support 310 of the lower moving contact head component is also used for installation of the transverse pin 221. Referring to FIG. 3 again, the moving contact head unit 320 consists of four single moving contact heads in parallel; wherein, each single moving contact head 321 is a long sheet, the center of which is equipped with a long hole 322 moving transversely through the single moving contact head 321; and both ends of which provided respectively with a contact point. Referring to FIG. 5, four single moving contact heads can be combined in parallel using a circular/round pin 323 passing through the long holes 322 on the four single moving contact heads 321, and then the entire moving contact head unit 320 is installed in the support 310 by inserting the two ends of the circular pin into the cylindrical pin holes on the groove edge at both sides of the support 310. By this installing mode, the entire moving contact head unit 320 can swing, at a certain, around the circular pin 323, and the upper and lower moving contact heads 320 are functionally formed a clip by the combination with the leaf spring component 330.

Each moving contact head unit in this embodiment uses fours single moving contact heads 321, but the moving contact head unit 320 of the present invention isn't limited to four single moving contact heads 321. The number of single moving contact heads 321 can also be increased or decreased according to the conductive requirement of different tap switches.

Figure 4:
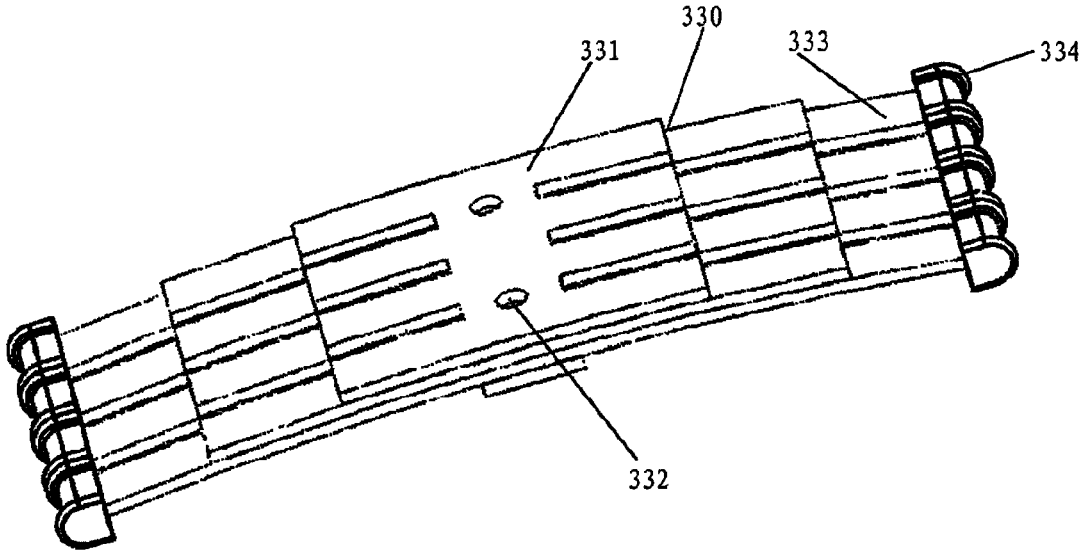
FIG. 4 is a structural diagram of a leaf spring component described in the present invention.

Referring to FIG. 4, the leaf spring component 330 is formed by the superposition of three leaf springs 331. The lengths of the three leaf springs 331 are shortened from bottom to top, that is to say, the bottom leaf spring 331 is longest, the middle leaf spring 331 is slightly shorter, and the top leaf spring is the shortest. The middle of each leaf spring 331 is opened with two second installation holes 332, which are corresponding to the two first installation holes 311 on the bottom surface of the groove of the support 310. Corresponding to four single moving-contact heads 321, the two ends of each leaf spring 331 are equipped with four leaf claws 333. The clawing head of each of the four leaf claws is used to withstand and press the single moving contact head 321 corresponding to it. The leaf claw 333 of the bottom leaf spring 331 is sleeved with an insulating sleeve 334, which plays an insulating, magnetic- and heat-isolating role on the leaf claw 333, and can avoid that the leaf spring 331 is burnt out.

In the leaf spring component 330 of this embodiment, the number of the leaf springs 331 isn't limited to three, and can be increased according to the desired elastic force.

Referring to FIG. 5 and FIG. 6, the leaf spring component 330 is installed by the following methods: three leaf springs can be fastened on the internal wall of the groove bottom of the support 310 using two fasteners such as bolts passing through the second installation holes 332 on the three leaf springs and the first installation holes 311 on the bottom surface of the groove of the support; the clawing head of the leaf claw 333 withstands and presses down the corresponding single moving contact 321 to clamp the two moving contact head units 320 toward the middle, such that the two moving contact head units 320 is functionally similar to the clips, clamping the contacting ring 500 and the static contact head 600 (see FIG. 6).

Referring to FIG. 6, a holder-type moving contact head 300 is installed on a moving contact head rotary bracket 210 through a U-shaped support 220. A contacting ring 500 is clamped at one end of two moving contact head units 320, and a static contact head 600 is clamped at the other ends of the two moving contact head units to deform a leaf spring 331 in the leaf spring component 330. However, the reaction force by the leaf spring 331 causes to contact each single moving contact head 321 in the moving contact head unit 320 with the contacting ring 500 and the static contact head 600, at a desired pressure, to achieve the on-state of large current.

A moving contact head for tap switch of the present invention has the following advantages: the present invention can improve the conductive capability of the contact head; this embodiment can carry 1000 A working current, 20000 A short-circuit current and 50 KA peak current. The compact leaf spring used has a small size, so that the structure of the moving contact head component is compact and thereby the tap switch can be designed to be more compact and reasonable. The present invention can meet the different conductive requirement of tap switches by changing the number of the single moving contact heads in the moving contact head unit.

I claim:

1. A moving contact head for tap switches comprising a moving contact head installation plate component (200) rotating with a switch main shaft (100), and a holder-type moving contact head (300) arranged on the moving contact head installation plate component (200), and being characterized in that: the holder-type moving contact head (300) is divided into two sets of upper and lower moving contact head components, which are connected to each other and form a holder shape;

wherein each moving contact head component comprises a moving contact head unit (320) consisting of a plurality of single moving contact heads (321) in parallel, and a leaf spring component (330) arranged on the moving contact head component (320);

wherein a pressing force is applied to the moving contact head unit (320) by the leaf spring component (330), and both ends of each single moving contact head (321) are provided with a contact point, respectively; and wherein the moving contact head for tap switches is further characterized in that: the moving contact head component also comprises a support (310) in which the moving contact head unit (320) and the leaf spring component (330) are positioned.

2. The moving contact head for tap switches of claim 1, characterized in that: a first installation hole (311) for installation of the leaf spring component (330) is arranged on one surface of the support (310); the leaf spring component (330) is also equipped with a second installation hole (332) corresponding to the first installation hole (311); the leaf spring component (330) is fixed on a surface in the support (310) by a fastener passing through the first installation hole (311) and the second installation hole (332).

3. The moving contact head for tap switches of claim 1, characterized in that: the moving contact head unit (30) is installed on the support (310) through a circular pin (323) moving transversely throughout the moving contact head unit (320); the moving contact head unit can makes certain swing around the circular pin (323).

4. A moving contact head for tap switches comprising a moving contact head installation plate component (200) rotating with a switch main shaft (100), and a holder-type moving contact head (300) arranged on the moving contact head installation plate component (200), and being characterized in that: the holder-type moving contact head (300) is divided into two sets of upper and lower moving contact head components, which are connected to each other and form a holder shape; wherein, each moving contact head component comprises a moving contact head unit (320) consisting of a plurality of single moving contact heads (321) in parallel, and a leaf spring component (330) arranged on the moving contact head component (320);

wherein a pressing force is applied to the moving contact head unit (320) by the leaf spring component (330), and both ends of each single moving contact head (321) are provided with a contact point, respectively; and wherein the moving contact head for tap switches is further characterized in that: both ends of the leaf spring component (330) are equipped with a number of leaf claws (333); the number of the leaf claws (333) is equal to that of the single moving contact heads (321).

5. The moving contact head for tap switches of claim 4, characterized in that each clawing head of the leaf claw (333) of the leaf spring component (330) is sleeved with an insulating sleeve (334).

6. A moving contact head for tap switches comprising a moving contact head installation plate component (200) rotating with a switch main shaft (100), and a holder-type moving contact head (300) arranged on the moving contact head installation plate component (200), and being characterized in that: the holder-type moving contact head (300) is divided into two sets of upper and lower moving contact head components, which are connected to each other and form a holder shape; wherein, each moving contact head component comprises a moving contact head unit (320) consisting of a plurality of single moving contact heads (321) in parallel, and a leaf spring component (330) arranged on the moving contact head component (320);

wherein a pressing force is applied to the moving contact head unit (320) by the leaf spring component (330), and both ends of each single moving contact head (321) are provided with a contact point, respectively; and wherein the moving contact head for tap switches is further characterized in that: the moving contact head installation plate component (200) comprises a moving contact head rotary bracket (210) arranged on a switch main shaft (100) and rotating with it, and a U-shaped support (220) fixed at one end of the moving contact head rotary bracket; the holder-type moving contact head (300) is fixed on the U-shaped support (220) through a transverse pin (221).

7. A moving contact head for tap switches comprising a moving contact head installation plate component (200) rotating with a switch main shaft (100), and a holder-type moving contact head (300) arranged on the moving contact head installation plate component (200), and being characterized in that: the holder-type moving contact head (300) is divided into two sets of upper and lower moving contact head components, which are connected to each other and form a holder shape; wherein, each moving contact head component comprises a moving contact head unit (320) consisting of a plurality of single moving contact heads (321) in parallel, and a leaf spring component (330) arranged on the moving contact head component (320);

wherein a pressing force is applied to the moving contact head unit (320) by the leaf spring component (330), and both ends of each single moving contact head (321) are provided with a contact point, respectively; and wherein the moving contact head for tap switches is further characterized in that: the leaf spring component (330) is formed by superposition of a plurality of leaf springs, and lengths of the leaf springs are shortened from bottom to top.

8. A moving contact head for tap switches comprising a moving contact head installation plate component (200) rotating with a switch main shaft (100), and a holder-type moving contact head (300) arranged on the moving contact head installation plate component (200), and being characterized in that: the holder-type moving contact head (300) is divided into two sets of upper and lower moving contact head components, which are connected to each other and form a holder shape; wherein, each moving contact head component comprises a moving contact head unit (320) consisting of a plurality of single moving contact heads (321) in parallel, and a leaf spring component (330) arranged on the moving contact head component (320);

wherein a pressing force is applied to the moving contact head unit (320) by the leaf spring component (330), and both ends of each single moving contact head (321) are provided with a contact point, respectively; and wherein the moving contact head for tap switches is further characterized in that: both ends of each leaf spring (331) is equipped with a number of leaf claws (333), and the number of the leaf claws (333) is equal for both ends of each leaf spring (331).

* * * * *